US012637241B1

(12) United States Patent
Sotero

(10) Patent No.: US 12,637,241 B1
(45) Date of Patent: May 26, 2026

(54) SANDBAGGING DEVICE

(71) Applicant: UNIQUE HOLDING GROUP LLC, Miami, FL (US)

(72) Inventor: Adalberto L Sotero, Miami, FL (US)

( * ) Notice: Subject to any disclaimer, the term of this patent is extended or adjusted under 35 U.S.C. 154(b) by 0 days.

(21) Appl. No.: 19/039,373

(22) Filed: Jan. 28, 2025

(51) Int. Cl.
*B65B 1/12* (2006.01)

(52) U.S. Cl.
CPC ..... *B65B 1/12* (2013.01); *B65B 2210/02* (2013.01)

(58) Field of Classification Search
CPC ..... B65B 1/12; B65B 2010/02
See application file for complete search history.

(56) References Cited

U.S. PATENT DOCUMENTS

| | | | | |
|---|---|---|---|---|
| 6,237,309 | B1 * | 5/2001 | DeMarco | B65B 1/12 141/83 |
| 7,510,365 | B2 * | 3/2009 | Babiarz | E02F 3/3414 37/903 |
| 11,390,401 | B2 * | 7/2022 | Sotero | B60P 1/40 |
| 2006/0151057 | A1 * | 7/2006 | Sweningson | B65B 1/12 141/10 |

* cited by examiner

*Primary Examiner* — Jason K Niesz

(57) ABSTRACT

An improved sandbagging device for use with a dump truck, the device comprising a self-contained pivotable tailgate designed to replace the original tailgate of the truck. The tailgate includes an integral elongated housing, within which two half-augers are rotatably installed. Each half-auger is independently powered by a separate hydraulic motor and is configured to rotate about a common axis to dispense sand from the truck bed. At the end of each half-auger, a bag-filler nozzle is positioned to receive and dispense sand. The system allows for efficient sandbagging by simultaneously operating both half-augers, enhancing the sand dispensing process and providing more control over the flow of sand.

2 Claims, 4 Drawing Sheets

SANDBAGGING DEVICE

FIELD OF THE INVENTION

The present invention relates to an apparatus designed for packaging bulk materials into containers. More specifically, it pertains to an enhanced device for bagging sand transported by vehicles such as trucks, trailers, and similar equipment. Even more specifically, the invention introduces an improved sandbagging system that can be adapted for use with a variety of sand-carrying vehicles, including, but not limited to, dump trucks, trailers, and other similar conveyances.

DESCRIPTION OF THE PRIOR ART

Sand is a crucial material used in a wide range of applications. For example, in construction, it is an essential component for producing concrete. Additionally, there are situations where sand must be provided in bags, such as in areas prone to hurricanes. In these regions, residents often place sandbags at the entrances of their homes to protect against flooding when a hurricane approaches. In many cities across the United States, local authorities offer a sandbagging service, delivering truckloads of sand to designated locations where residents can fill and collect sandbags to safeguard their homes.

A significant challenge in this process is the manual task of filling individual sandbags, which is both labor-intensive and time-consuming. The primary objective of this invention is to provide a device that can be easily installed on any dump truck or trailer, enabling efficient, fast, and convenient sandbag filling.

The present inventor previously addressed this challenge in U.S. Pat. No. 11,390,401, which describes a self-driven modular sandbagging device designed for use with a dump truck. This system includes a replacement tailgate for the truck bed, which defines a sand-carrying volume. The replacement tailgate features an integral elongated housing in contact with the truck bed's interior, within which an auger is rotatably installed. The auger is powered by a hydraulic motor located within the housing, while an external hydraulic pump is connected to the motor. At one end of the housing, a bag-filling nozzle is provided.

While this solution proved effective in providing sandbags quickly and efficiently during high-pressure situations, the device's single bag-filler nozzle presents a limitation. The goal of the present invention is to improve the sandbagging device described in U.S. Pat. No. 11,390,401 by adding an additional bag-filler nozzle, using a double auger thereby enhancing its efficiency without significantly altering the original design or introducing costly and complex modifications.

Thus, there is a clear need for an improved sandbagging device that can be easily adapted to dump trucks, trailers, and similar vehicles, allowing sand to be bagged quickly, conveniently, and efficiently, while overcoming the limitations of existing devices in the market.

SUMMARY OF THE INVENTION

The present invention overcomes the deficiencies of the sandbagging devices of the prior art by providing an easy-to-install, modular, self-driven, and practical sandbagging device. In a first exemplary embodiment, the sandbagging device in accordance with the present invention comprises: a self-contained pivotable tailgate, including:

- an integral elongated housing having first and second sides and extending in a first direction, adapted to be in free contact with the carrying volume of the truck bed;
- a first half-auger and a second half-auger, each rotatably installed in said housing, each half-auger powered by a separate hydraulic motor located inside said housing;
- the first and second half-augers being configured to rotate in opposite directions about a common axis to dispense sand from said sand-carrying volume through an opening in the first side of said housing;
- a hydraulic pump connected to the hydraulic motors and attached to the self-contained pivotable tailgate;
- a first bag-filler nozzle located at the end of the first half-auger and a second bag-filler nozzle located at the end of the second half-auger, wherein each bag-filler nozzle is configured to receive and dispense sand from said first and second half-augers, respectively.

It is also an objective of the present invention to provide a sandbagging device that includes a hydraulic motor powered by a pump mounted on the external face of the tailgate, which operates independently of the truck's power system.

It is another objective of the present invention to provide a sandbagging device that features two half-augers rotatably mounted within an auger housing, which is integrally formed as part of the lower inner edge of the tailgate.

It is also an objective of the present invention to provide a sandbagging device with two hydraulic motors, each independently driving one of the half-augers located inside the auger housing.

A further objective of the present invention is to provide a sandbagging device that includes a sandbag-filler nozzle at the end of each half-auger, facilitating efficient sand dispensing.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF REPRESENTATIVE EMBODIMENTS

Figure 1:
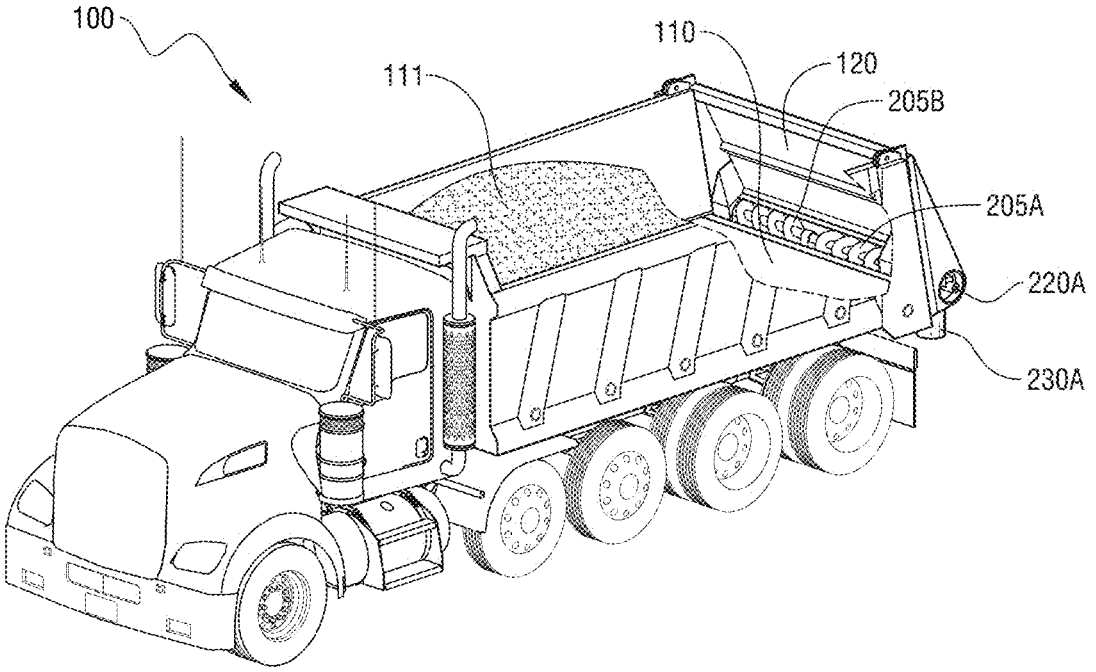
FIG. 1 is a perspective view showing the dump truck equipped with the sandbagging device according to the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable people skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices illustrated in the attached drawings, and described in the following specification, are simply exemplary embodiments of the inventive concepts defined in the appended claim. Hence, specific dimensions and other physical characteristics relating to the embodiments disclosed herein are not to be considered as limiting, unless the claims expressly state otherwise.

A dump truck 100, as illustrated in FIGS. 1 through 4, features a truck bed 110 (defining a carrying volume 111) and a tailgate 120. The truck includes standard hydraulic mechanisms capable of rotating the truck bed around a fulcrum, which are not illustrated here as they are outside the scope of this invention.

Figure 2:
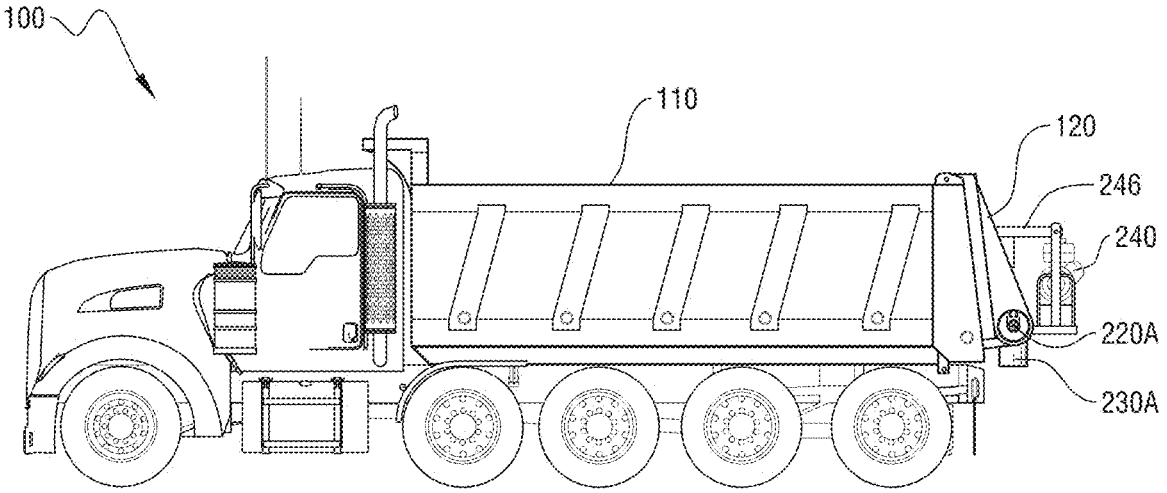
FIG. 2 is a side elevational view of the dump truck with the sandbagging device installed on the outer face of the tailgate of the truck bed.
Figure 3:
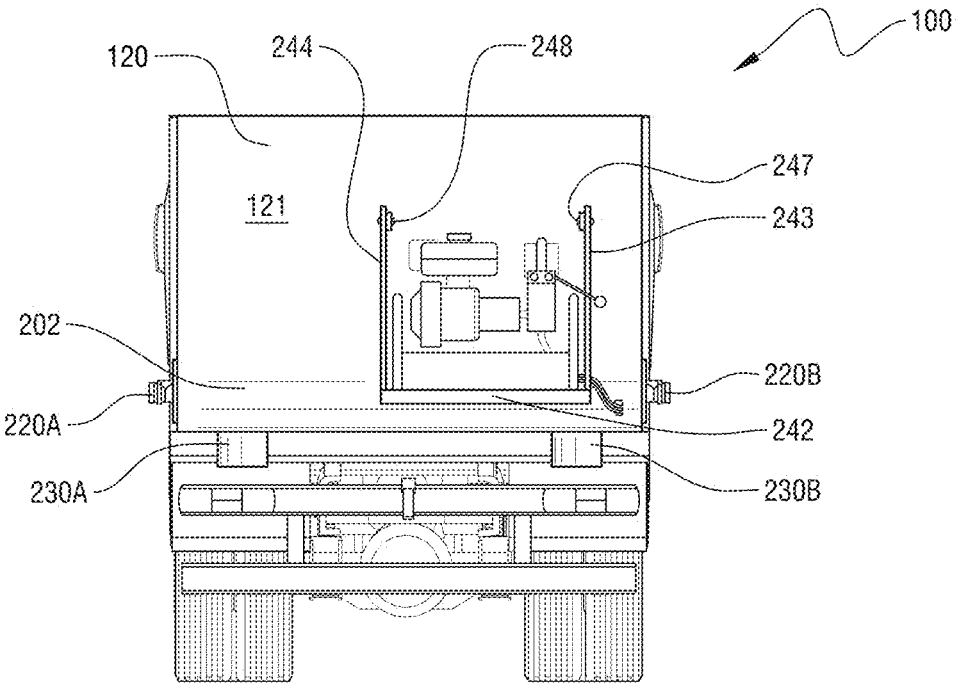
FIG. 3 is a rear elevational view of the tailgate featuring the sandbagging device, shown in its passive (or stored) position.
Figure 4:
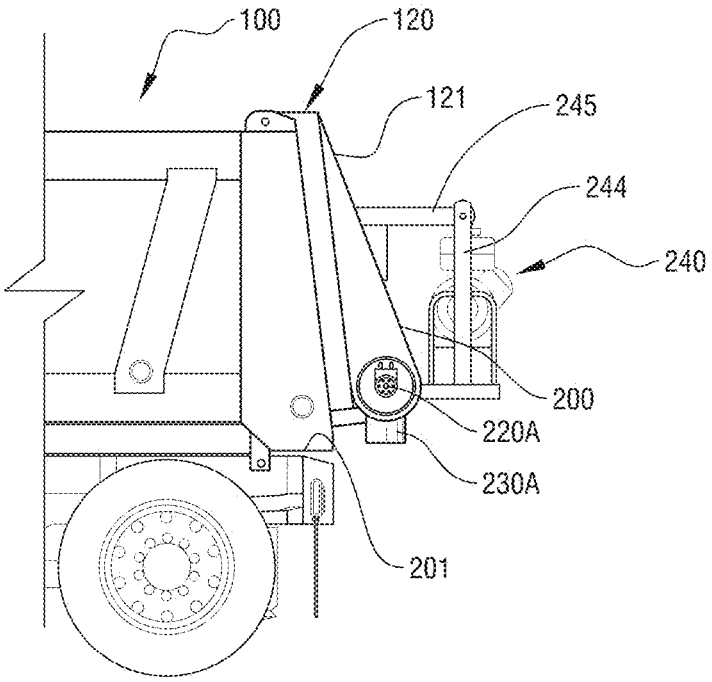
FIG. 4 is an elevation view providing a detailed view of the sandbagging device with the sand-filler nozzle in the open position for sand dispensing.
Figure 5:
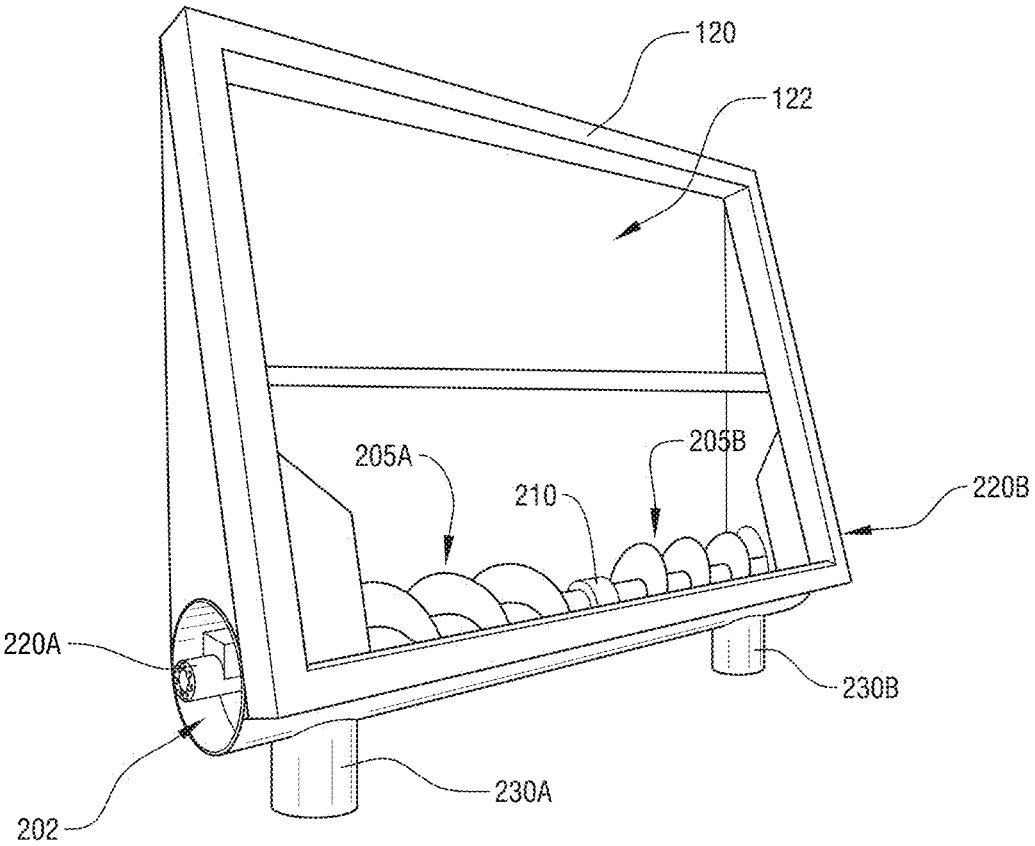
FIG. 5 is a perspective view of the sandbagging device, highlighting the auger housing, the two half-augers, and the hydraulic motors that power them.
Figure 6:
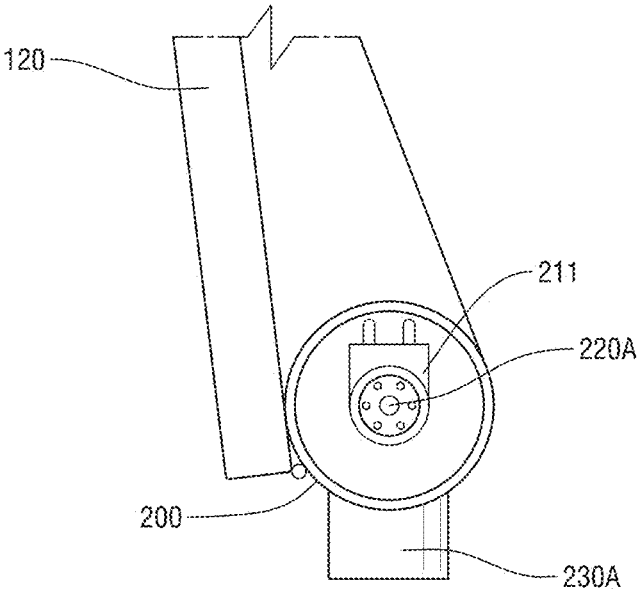
FIG. 6 is an elevational view showing in detail the sand-filler nozzle and the supporting structure for the auger axis.
Figure 7:
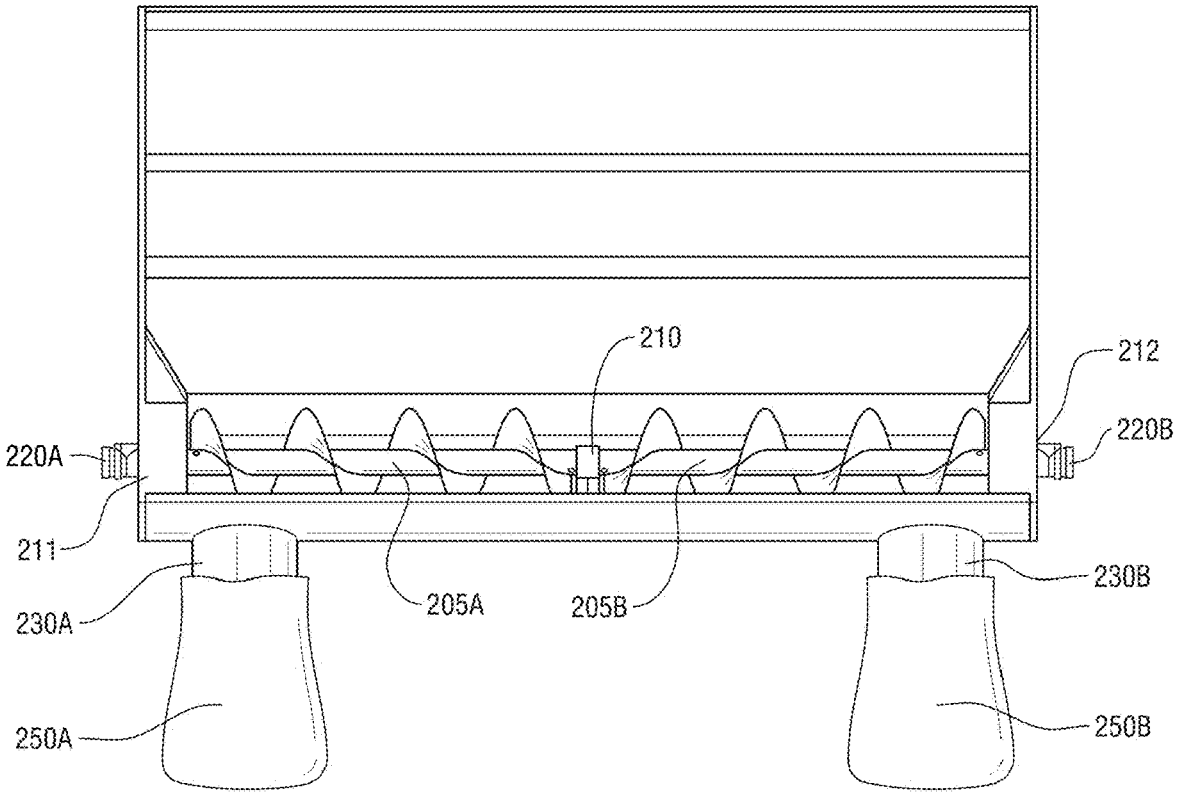
FIG. 7 is another perspective view of the sandbagging device, providing a detailed look at the auger housing, the two augers, the hydraulic pumps that drive them, and the two sand-filler nozzles.
Figure 8:
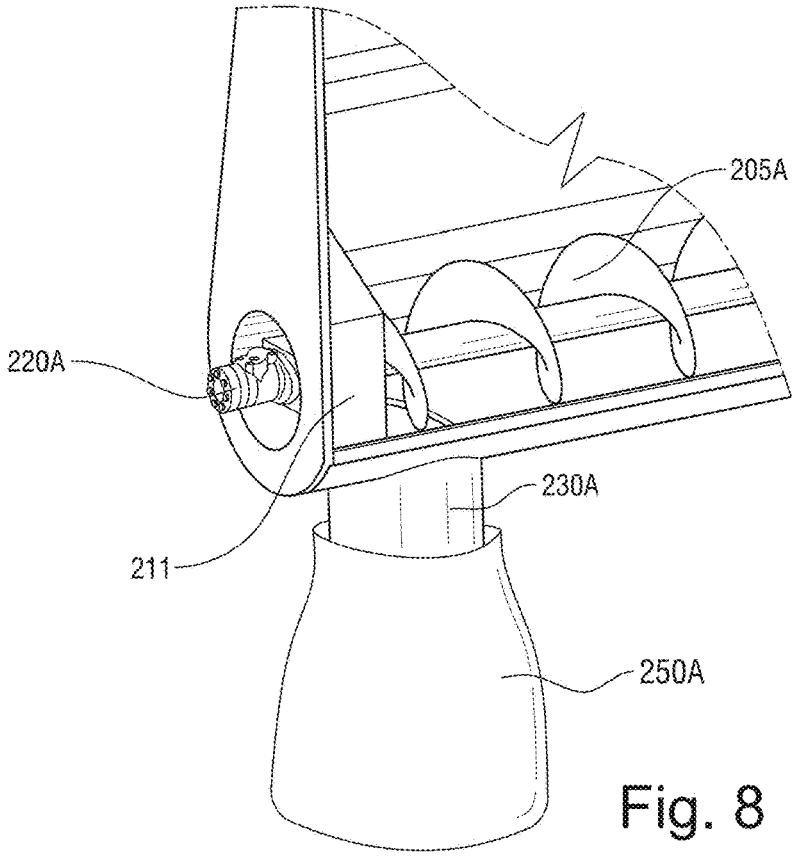
FIG. 8 is a close-up perspective view showing the end of one of the augers, its associated hydraulic motor, and the sand-filler nozzle.

As depicted in FIGS. 1 and 2, the original tailgate of the dump truck 100 has been replaced with the innovative sandbagging device 200. This device functions as a regular tailgate while incorporating additional features described below, making it an integral part of the invention.

The replacement process is straightforward because the sandbagging device 200 operates autonomously, requiring no connection to the truck's pneumatic, hydraulic, or electrical systems.

The self-contained modular sandbagging device 200 comprises a replacement tailgate designed to substitute the original tailgate of the dump truck 100. At its lower inner edge 201, the replacement tailgate incorporates an elongated housing 202, which remains in direct contact with the carrying volume 111 of the truck bed. When the carrying volume is filled with sand, the housing 202 also becomes filled with sand, as described below.

Inside the elongated housing 202, two augers, 205A and 205B, are mounted for rotation. Auger 205A is supported between axle boxes 210 and 211, while auger 205B is supported between axle boxes 210 and 212, all positioned within the housing 202.

The rotation of auger 205A is powered by a hydraulic motor 220A, and auger 205B is powered by a hydraulic motor 220B, both of which are powered by the hydraulic pump 240 and located inside the housing 202.

At either end of the housing 202, bag-filling nozzles 230A and 230B are mounted. This dual-nozzle configuration doubles the sandbagging capacity of the device without significantly increasing costs or introducing complex mechanisms.

When the truck arrives at a location where sandbags are needed, the following procedure is performed:

- The lid of the housing 202 is opened.
- The nozzles 230A and 230B are rotated into position and coupled to the housing's outlets.
- The nozzles are adjusted to their operational orientation.
- Bags 250A and 250B are positioned at the ends of nozzles 230A and 230B, respectively.
- The pump 240 and hydraulic motors 220A and 220B are activated.
- The augers start rotating moving the sand from the truck bed to the nozzles and bags 250A-B.

The augers begin rotating: auger 205A moves sand from the carrying volume 111 into nozzle 230A, filling bag 250A, while auger 205B moves sand in the opposite direction, filling bag 250B through nozzle 230B. Once the operation is complete, the pump and motors are turned off, the nozzles are rotated back to their original positions, and the truck is ready to transport additional sand or return to another location.

If there is only one operator of this device both augers may rotate in the same direction flowing the sand to only one nozzle.

Finally, even though in the present description a separate pump unit drives the present device, it may be replaced by the trunk pump or an electric motor.

While the preferred embodiments of the invention have been described above, it will be recognized and understood that various modifications can be made in the invention and the appended claims are intended to cover all such modifications which may fall within the spirit and scope of the invention.

REFERENCE ELEMENT LIST

Ref No./Description

100 dump truck
110 truck bed
111 carrying volume
120 tailgate
200 sandbagging device
201 lower inner end of the replacing tailgate
200 202 integral elongated housing
205A first auger
205B second auger
207A axis of the auger
205 206 supports
208 lid
209 lid
210 axle box
211 axle box
220A first hydraulic motor
220B second hydraulic motor
230A first bag-filler nozzle
230B second bag-filler nozzle
231 hinge
240 hydraulic pump
241 pump support
242 base
243 parallel rigid arms

244 parallel rigid arms
245 transversal arms
246 transversal arms
247 fulcrum
248 fulcrum
250 bag

The invention claimed is:

1. An improved sandbagging device applicable to a dump truck comprising a pivotable tailgate and a truck bed defining a sand-carrying volume, the device comprising:

a self-contained pivotable tailgate, capable of replacing the pivotable tailgate of the dump truck, the self-contained pivotable tailgate including:

an integral elongated housing having first and second sides and extending in a first direction, adapted to be in free contact with the carrying volume of the truck bed;

a first auger extending inside the housing from a central axle box to a first hydraulic motor mounted on the first side of the housing;

a second auger extending inside the housing from the central axle box to a second hydraulic motor mounted on the second side of the housing;

the first and second augers being configured to rotate independently in either the same or opposite directions about a common axis;

a hydraulic pump connected to the first and second hydraulic motors and attached to the self-contained pivotable tailgate;

a first bag-filler nozzle located proximal to the first side of the housing and underneath the first auger;

a second bag-filler nozzle located proximal to the second side of the housing and underneath the second auger, wherein each bag-filler nozzle is configured to receive and dispense sand from said first and second half-augers, respectively.

2. The improved sandbagging device of claim 1, wherein the hydraulic pump is driven by an electric motor.

* * * * *